US009074409B2

(12) United States Patent
Liang et al.

(10) Patent No.: US 9,074,409 B2
(45) Date of Patent: Jul. 7, 2015

(54) SAFETY ROPE ASSEMBLY FOR ROMAN SHADE

(71) Applicants: CHING FENG HOME FASHIONS CO., LTD., Fuxing Shiang, Changhua County (TW); A-Nan Chen, Lukang Township, Changhua County (TW)

(72) Inventors: Wen Ying Liang, Fuxing Shiang (TW); A-Nan Chen, Lukang Township, Changhua County (TW)

(73) Assignees: CHING FENG HOME FASHIONS CO., LTD., Changhua County (TW); A-Nan Chen, Changhua County (TW)

( * ) Notice: Subject to any disclaimer, the term of this patent is extended or adjusted under 35 U.S.C. 154(b) by 0 days.

(21) Appl. No.: 14/033,514

(22) Filed: Sep. 22, 2013

(65) Prior Publication Data

US 2014/0290872 A1 Oct. 2, 2014

(30) Foreign Application Priority Data

Mar. 28, 2013 (TW) ..... 102205779 U

(51) Int. Cl.

| | |
|---|---|
| ***A47H 5/00*** | (2006.01) |
| ***E06B 9/262*** | (2006.01) |
| ***E06B 9/384*** | (2006.01) |

(52) U.S. Cl.

CPC ..... *E06B 9/262* (2013.01); *E06B 9/384* (2013.01); *E06B 2009/2622* (2013.01)

(58) Field of Classification Search

CPC ..... E06B 9/262; E06B 2009/2622; E06B 2009/2625

USPC ..... 160/84.01, 84.04

See application file for complete search history.

(56) References Cited

U.S. PATENT DOCUMENTS

| | | | | |
|---|---|---|---|---|
| 8,813,807 | B1 * | 8/2014 | LeBlanc | 160/84.01 |
| 2010/0326608 | A1 * | 12/2010 | Wen et al. | 160/340 |
| 2011/0100569 | A1 * | 5/2011 | Perkowitz | 160/340 |
| 2011/0203079 | A1 * | 8/2011 | Anthony et al. | 24/115 F |

* cited by examiner

*Primary Examiner* — Blair M Johnson

(57) ABSTRACT

A Roman shade includes a shade having multiple folded sections formed thereon and multiple control units are connected to the folded sections. Each control unit includes a connection unit and a rope unit. The connection unit and the rope unit share a common end. The connection unit is sewed to the folded sections so as to allow the transmission rope in the connection unit to move freely within the connection unit. The distance between the connection ropes of the rope unit restricts the transmission rope from being pulled out easily.

6 Claims, 9 Drawing Sheets

SAFETY ROPE ASSEMBLY FOR ROMAN SHADE

FIELD OF THE INVENTION

The present invention relates to a safety rope assembly, and more particularly, to a safety rope assembly for a Roman shade.

BACKGROUND OF THE INVENTION

The conventional rope assembly for a Roman shade is disclosed in U.S. Pat. No. 8,316,911 and generally comprises a shade 61 fixed to the head box 60 and the shade 61 has multiple folded sections 62. Each folded section 62 has two rings 80 connected thereto (only one is shown) and two transmission ropes 70 (only one is shown) each have one end fixed to the bottom bar of the shade 61 and the other end of each transmission rope 70 extends through the rings 80 and is connected to the transmission mechanism in the head box 60. The transmission ropes 70 are connected to the operation rope 74. When the user operates the operation rope 74, the shade 61 is lifted or lowered by the transmission ropes 70. However, the transmission ropes 70 are exposed to kids who can easily pull the transmission ropes 70 between rings 80 to form a loop as shown in FIG. 7, and the loop may cause danger to the kids.

FIG. 8 shows an improved rope assembly for the Roman shade as mentioned before, and has two longitudinal ropes 71 with multiple connection ropes 72 connected between the two longitudinal ropes 71. Each transmission rope 70 extends alternatively through the connection ropes 71 and is located between the through the two longitudinal ropes 71. The transmission ropes 70 extend through the rings 80. By this arrangement, the transmission ropes 70 are difficult to be pulled out, but the assembling steps are complicated and take a lot of time.

FIG. 9 shows yet another rope assembly for a Roman shade, wherein each of the transmission ropes 70 is located in a sleeve 73, and after the combination of the transmission rope 70 and the sleeve 73 extends through the rings 80, a fastener 81 is used to fix the combination to reach of the rings 80. The sleeve 73 restricts the transmission rope 70 to be pulled only the length the same as the distance between the two rings 80. However, there are too many parts involved which cause the assembling steps to be complicated.

The present invention intends to provide a safety rope assembly for a Roman shade and the transmission ropes are difficult to be pulled out.

SUMMARY OF THE INVENTION

The present invention relates to a Roman shade and comprises a shade having multiple folded sections formed thereon. A control unit comprises a connection unit and a rope unit, wherein the connection unit is sewed to the folded section and has a first rope, a second rope and a third rope. Multiple fixing ropes are connected to the first rope, the second rope and the third rope. The rope unit has the first rope, a fourth rope, a transmission rope and multiple connection ropes. The connection ropes are connected transversely between the first rope and the fourth rope. The transmission rope extends alternatively between the connection ropes. The transmission rope are movable between the connection ropes. The distance between the connection ropes restricts the transmission rope from being pulled out.

Preferably, the control unit is made by way of weaving.

Preferably, the fixing ropes are fixed to the first, second and third ropes by way of weaving.

Preferably, the connection unit extends across the first, second and third ropes and is sewed to the folded sections.

Preferably, the transmission rope extends alternatively between the connection ropes which are located between the first and fourth ropes.

Preferably, each of the connection ropes is a loop, and the transmission rope extends through the loops and is freely movable within the loops.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
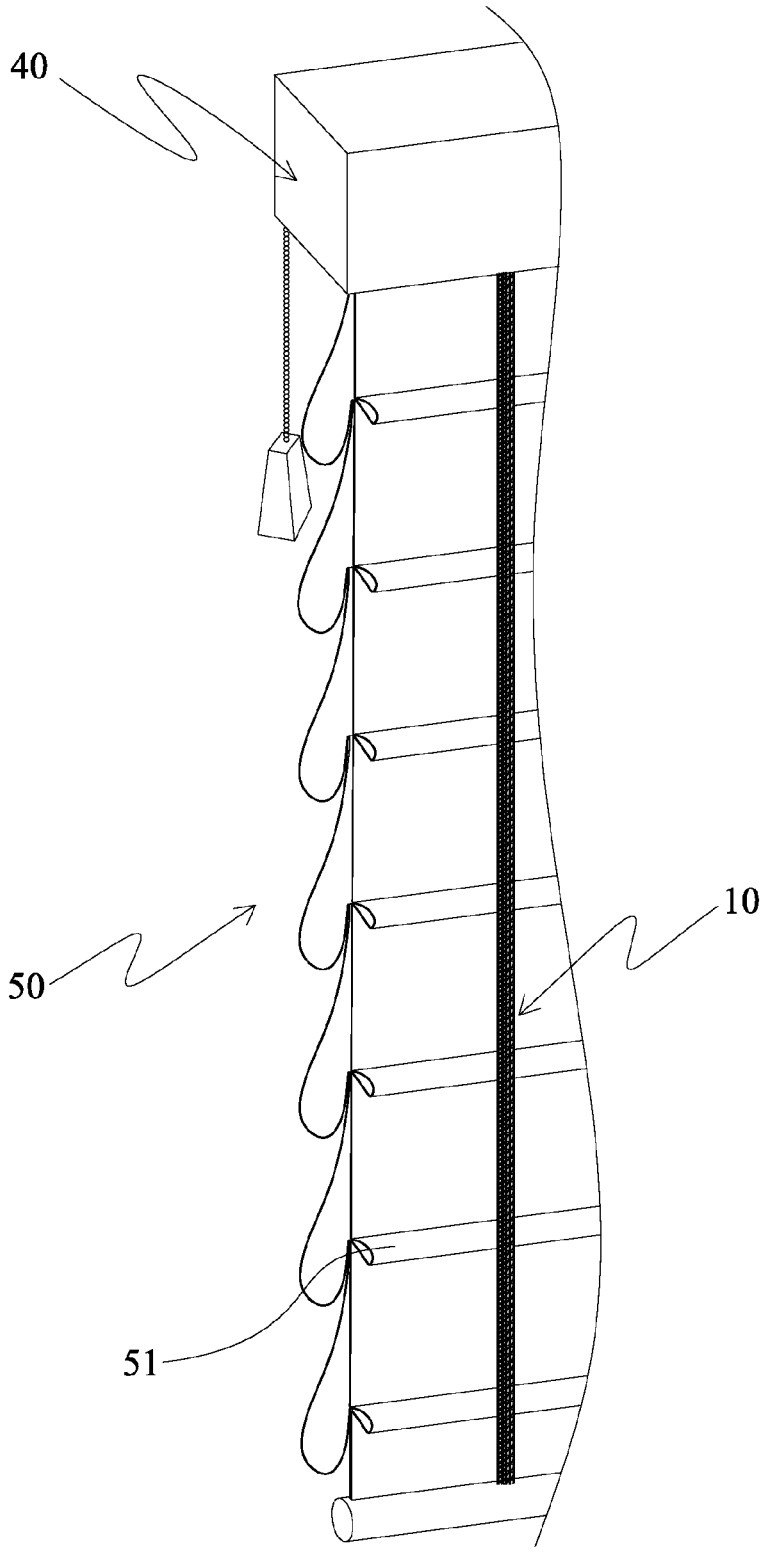
FIG. 1 is a perspective view to show the safety rope assembly of the present invention is cooperated with a Roman shade.
Figure 2:
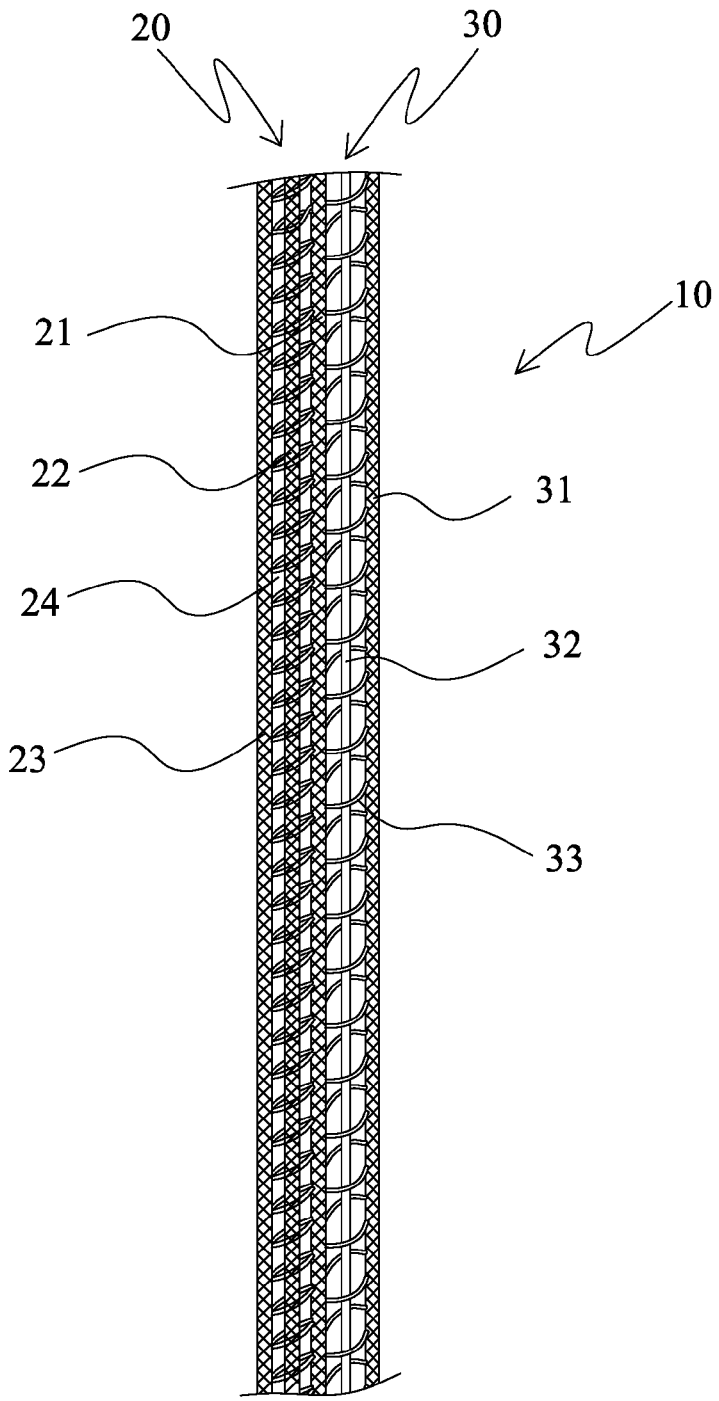
FIG. 2 shows the safety rope assembly of the present invention.
Figure 3:
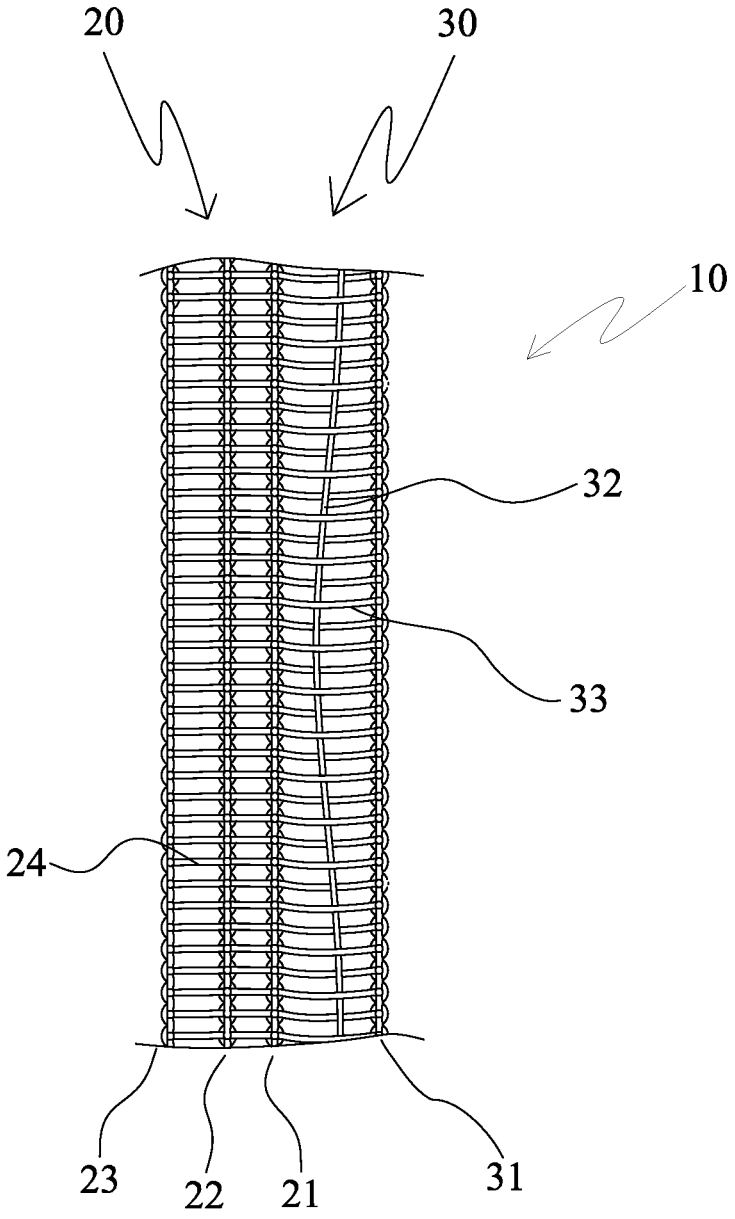
FIG. 3 shows the safety rope assembly of the present invention made by way of weaving.
Figure 4:
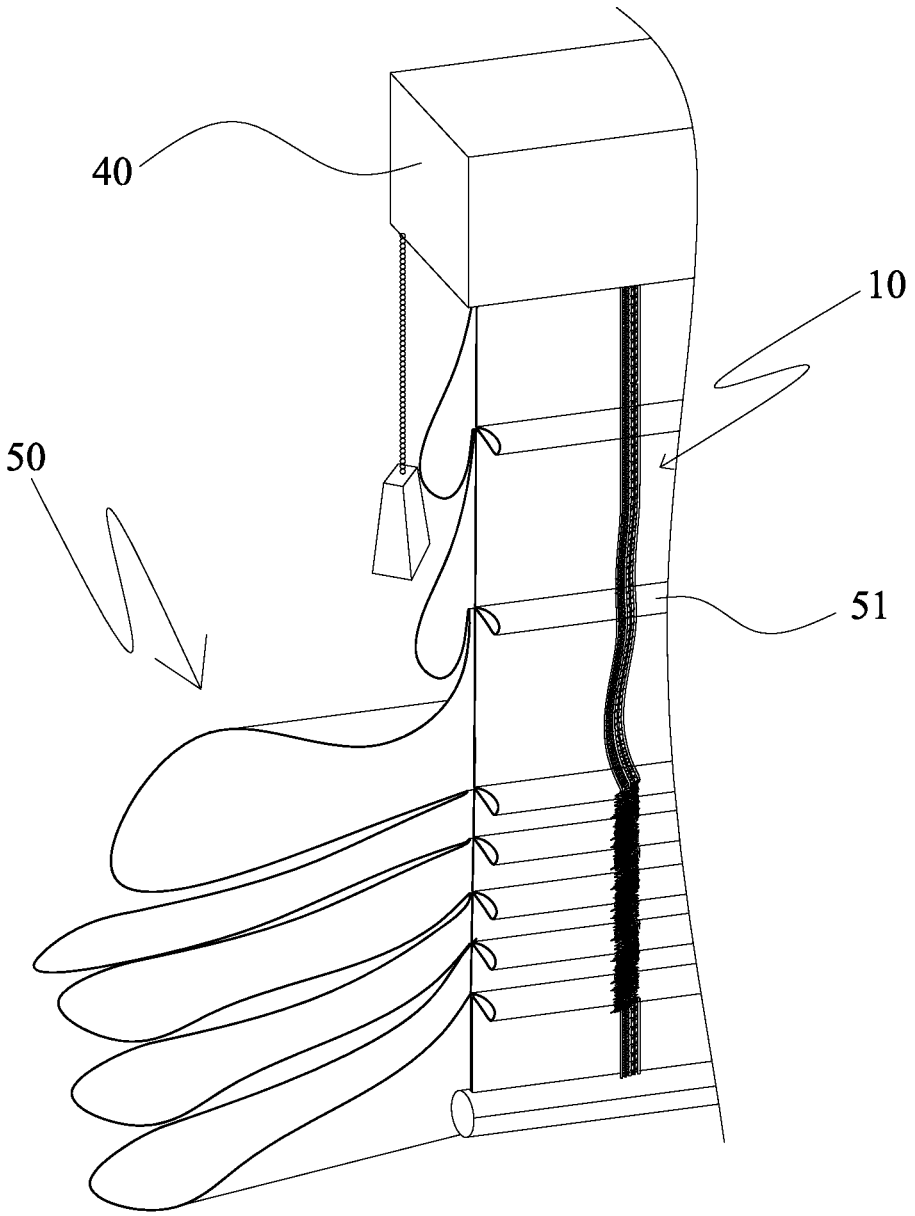
FIG. 4 shows that the safety rope assembly of the present invention is cooperated with a Roman shade which is partially collected.
Figure 5:
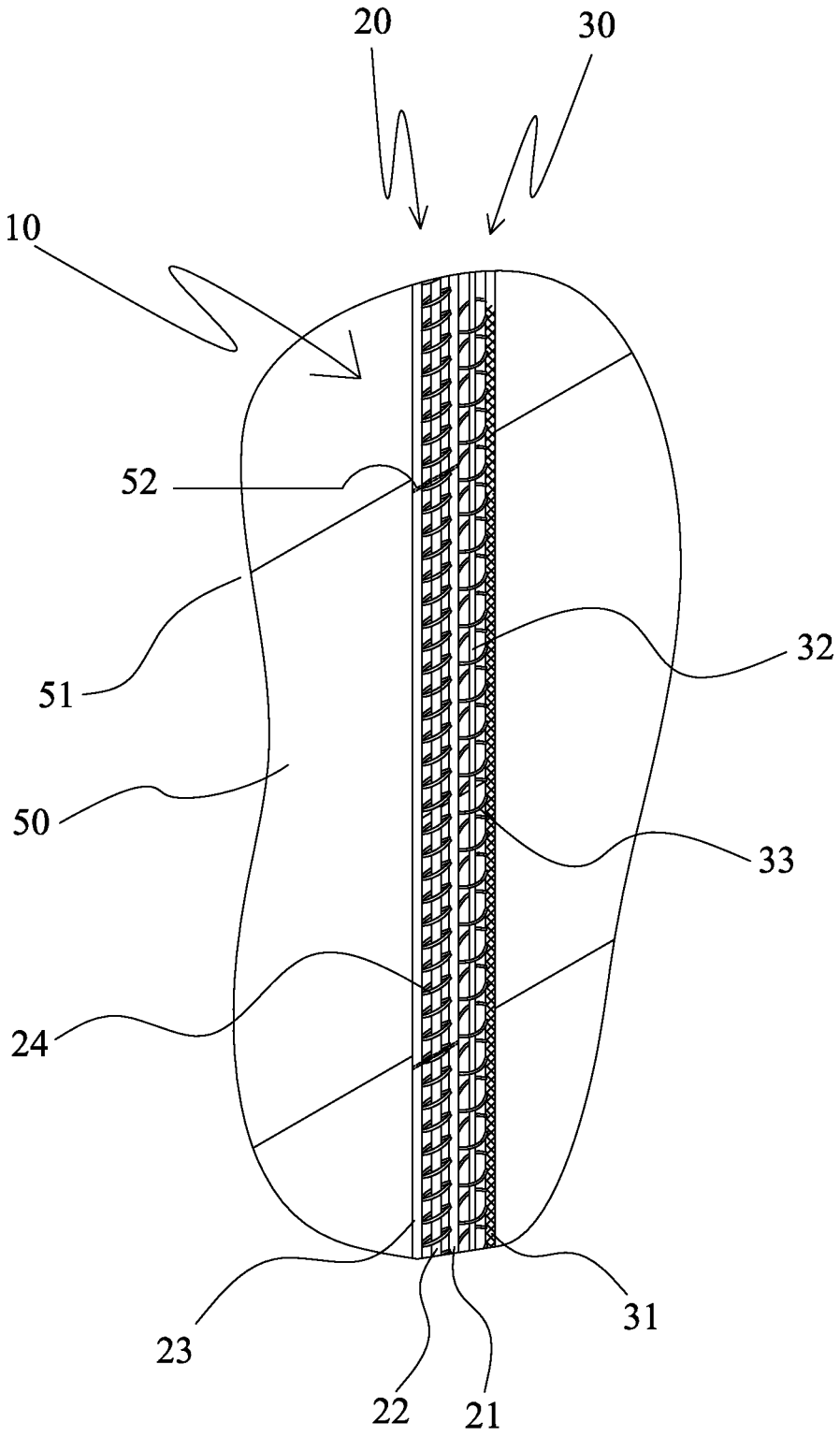
FIG. 5 is an enlarged view to show the safety rope assembly of the present invention cooperated with a Roman shade.
Figure 6:
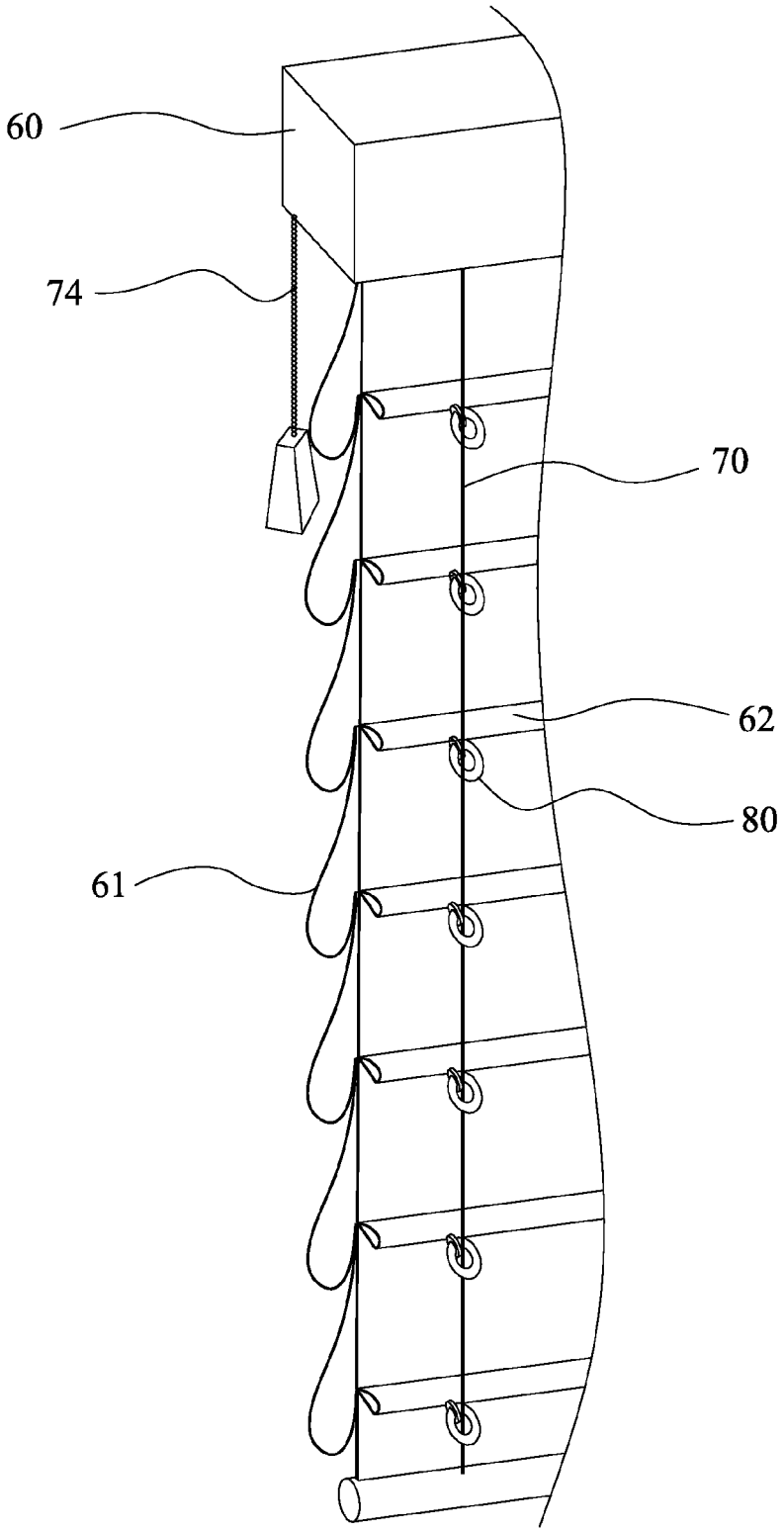
FIG. 6 PRIOR ART
FIG. 6 is a perspective view to show the conventional rope assembly cooperated with a Roman shade.
Figure 7:
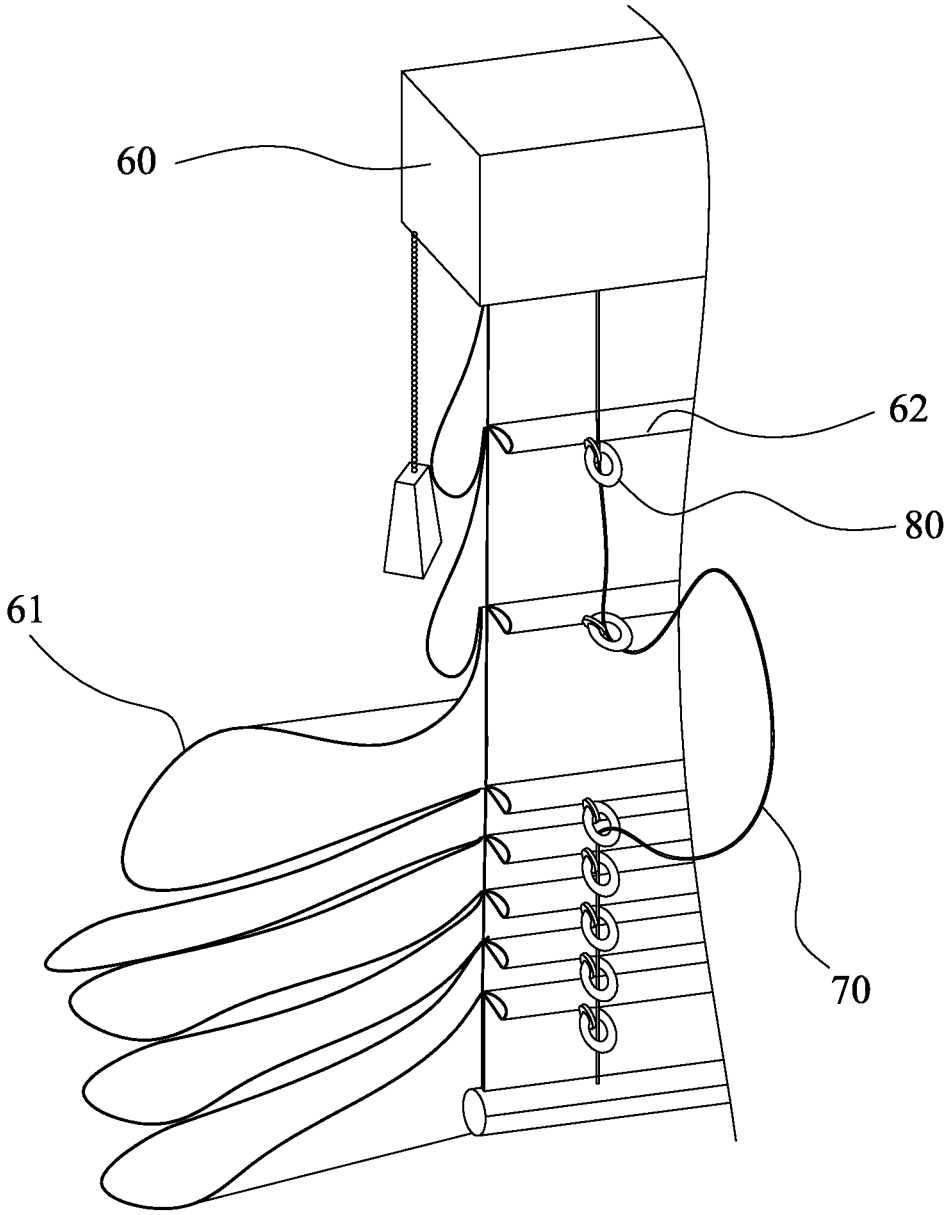
PRIOR ART FIG. 7
FIG. 7 shows that the transmission rope of the conventional rope assembly is pulled out.
Figure 8:
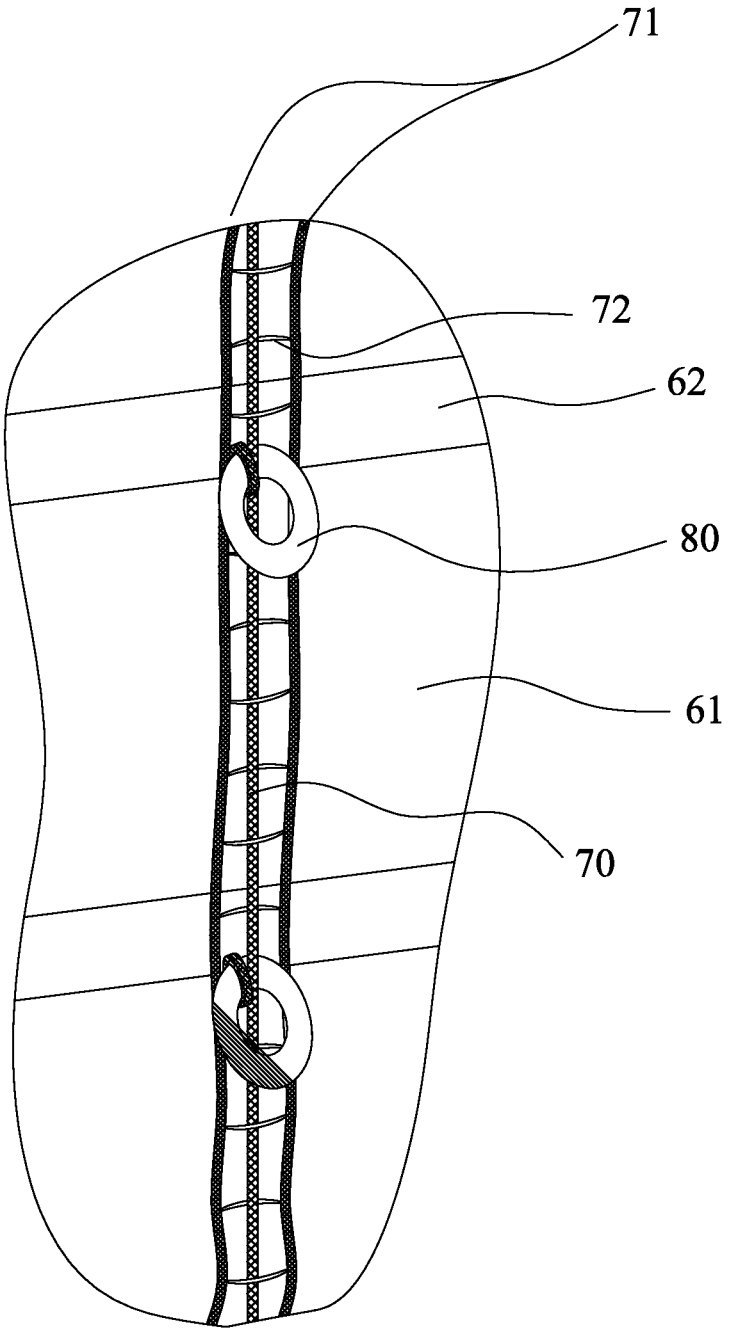
PRIOR ART FIG. 8
FIG. 8 is a second embodiment of the conventional rope assembly.
Figure 9:
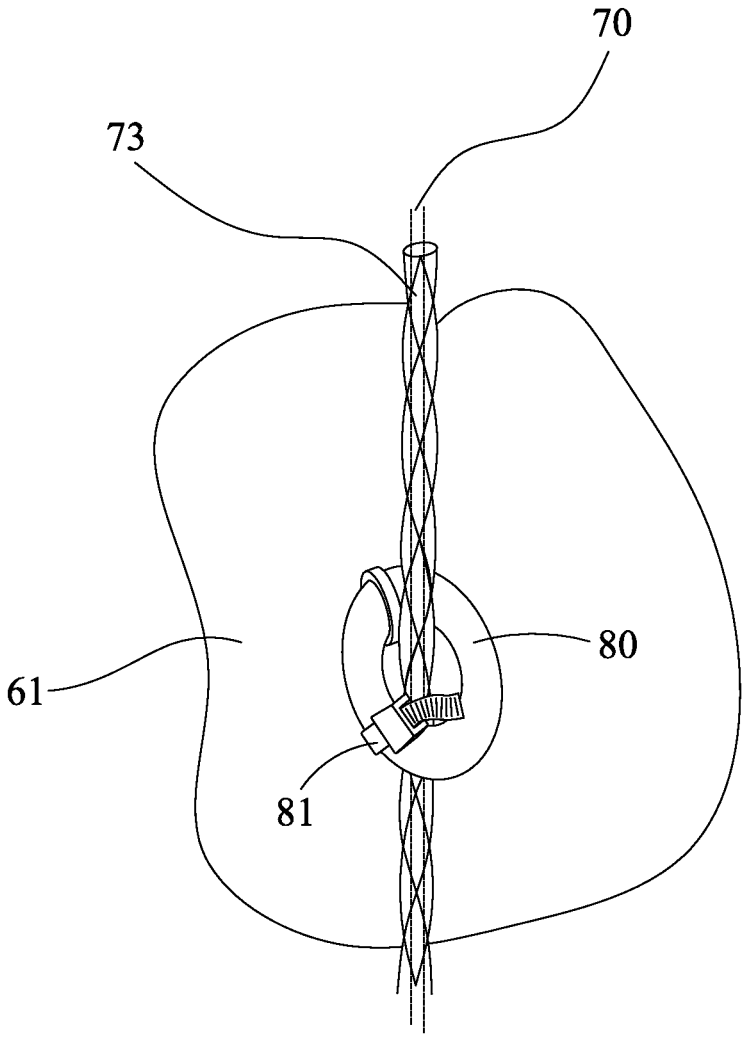
PRIOR ART FIG. 9
FIG. 9 is a third embodiment of the conventional rope assembly.

Referring to FIGS. 1 and 2, the Roman shade of the present invention comprises a shade 50 which has multiple folded sections 51 formed thereon.

The safety rope assembly comprises a control unit 10 which has a connection unit 20 and a rope unit 30. The connection unit 20 has a first rope 21, a second rope 22 and a third rope 23. Multiple fixing ropes 24 are connected to the first rope 21, the second rope 22 and the third rope 23. The rope unit 30 has the first rope 21, a fourth rope 31, a transmission rope 32 and multiple connection ropes 33. The connection ropes 33 are connected transversely between the first rope 21 and the fourth rope 31, and the transmission rope 32 extends alternatively between the connection ropes 33. The first rope 21 is commonly used for both of the connection unit 20 and the rope unit 30.

The control unit 10 is made by way of weaving. The fixing rope 24 is pulled laterally from the third rope 23 and the fixing rope 24 is then connected to the second rope 22 and the first rope 21. The connection rope 33 is pulled laterally from the fourth rope 31 and the connection rope 33 is then connected to the first rope 21. The transmission rope 32 extends between the connection ropes 33 when weaving the control unit 10. The distances between the connection ropes 33 can be adjustable.

As shown in FIGS. 1 to 5, the shade 50 is connected to the lower edge of the head box 40 and the folded sections 51 are folded and formed at equal distances therebetween. The connection unit 20 extends across the first, second and third ropes 21, 22, 23 and is sewed to the folded sections 51. The connection unit 20 is sewed to some of the folded sections 51 by sewed portions 52. The fixing ropes 24 are fixed to the first, second and third ropes 21, 22, 23 to form the connection unit 20 so that the connection unit 20 can be applied by larger pulling force and does not break. The transmission rope 32 extends alternatively between the connection ropes 33 which are located between the first rope 21 and the fourth rope 31. The first rope 21 and the fourth rope 31 are fixed to two ends of the connection ropes 33. There are multiple control units 10 connected to the head box 40, and the connection unit 20 is sewed to the folded sections 51 of the shade 50, so that the when operating the control units 10, the small distances between the connection ropes 33 restrict the transmission rope 32 from being pulled out.

The connection unit 20 and the rope unit 30 are simultaneously manufactured when weaving the control unit 10. The connection ropes 33 are connected between the first and fourth ropes 21, 31. The transmission rope 32 extends alternatively between the connection ropes 33 when the control unit 10 is manufactured by way of weaving. The distances between the connection ropes 33 can be adjusted when manufacturing the control unit 10. The distances between the connection ropes 33 can be equal or not equal to each other. The distances are set to be smaller than the fingers of kids so that kids cannot pull the transmission rope 32 out.

Each of the connection ropes 33 can be a loop which is sized such that the transmission rope 32 extends through the loops 23 and freely movable within the loops. The distances between the loops should be controlled to restrict the transmission rope 32 from being pulled out. The transmission rope 32 is able to be operated steadily.

The distances are set to be smaller than the fingers of kids so that kids cannot pull the transmission rope 32 out, such that the risk of wrapping around the kid's neck can be avoided.

The control unit 10 is integrally formed by way of weaving and the control unit 10 is simply sewed to the folded sections 51 of the shade when assembling the Roman shade, no extra accessories are required.

While we have shown and described the embodiment in accordance with the present invention, it should be clear to those skilled in the art that further embodiments may be made without departing from the scope of the present invention.

What is claimed is:

1. A Roman shade comprising:

a shade having multiple folded sections;

a control unit having a connection unit and a rope unit, the connection unit having a first rope, a second rope and a third rope, multiple fixing ropes connected to the first rope, the second rope and the third rope, the rope unit having the first rope, a fourth rope, a transmission rope and multiple connection ropes, the connection ropes connected transversely between the first rope and the fourth rope, the transmission rope extending alternatively between the connection ropes, the connection unit connected to the folded sections of the shade, the transmission rope movable between the connection ropes, a distance between the connection ropes restricting the transmission rope from being pulled out.

2. The Roman shade as claimed in claim 1, wherein the control unit is made by way of weaving.

3. The Roman shade as claimed in claim 1, wherein the fixing ropes are fixed to the first, second and third ropes by way of weaving.

4. The Roman shade as claimed in claim 1, wherein the connection unit extends across the first, second and third ropes and is sewn to the folded sections.

5. The Roman shade as claimed in claim 1, wherein the transmission rope extends alternatively between the connection ropes which are located between the first and fourth ropes.

6. The Roman shade as claimed in claim 1, wherein each of the connection ropes is a loop, and the transmission rope extends through the loops and freely movable within the loops.

* * * * *